United States Patent [19]

Jones et al.

[11] 4,298,788

[45] Nov. 3, 1981

[54] TOY OVEN ASSEMBLY

[75] Inventors: Lawrence T. Jones, Playa Del Rey; Anson Sims, Granada Hills; Ashley G. Howden; Mark S. Knighton, both of Los Angeles; LC James Kingsbury, Fountain Valley, all of Calif.

[73] Assignee: California R & D Center, Culver City, Calif.

[21] Appl. No.: 115,380

[22] Filed: Jan. 25, 1980

[51] Int. Cl.[3] ..... H05B 1/00

[52] U.S. Cl. ..... 219/386; 219/220

[58] Field of Search ..... 219/220, 354, 411, 405, 219/386, 552; 46/14, 226; 49/390; 222/334

[56] References Cited

U.S. PATENT DOCUMENTS

| | | | |
|---|---|---|---|
| 1,144,508 | 6/1915 | Taylor, Jr. | 219/220 |
| 1,780,649 | 11/1930 | Jacobs | 219/220 |
| 2,413,176 | 12/1946 | Deaton | 219/220 |
| 2,457,302 | 12/1948 | Christensen | 219/552 |
| 3,280,720 | 10/1966 | Kuhn | 219/411 |
| 3,368,063 | 2/1965 | Kuhn | 219/405 |
| 3,548,146 | 12/1970 | Hoyland | 219/354 |
| 4,003,142 | 1/1977 | Morrison et al. | 219/220 |

*Primary Examiner*—Gerald P. Tolin
*Assistant Examiner*—Bernard Roskoski
*Attorney, Agent, or Firm*—Jackson, Jones & Price

[57] ABSTRACT

A toy oven assembly having a light bulb acting as a light and a heat source, is disclosed. The toy oven includes two identical component parts which are assembled to one another. In their assembled form they incorporate a substantially circular opening on a substantially horizontal top surface of the assembly. The circular opening is surrounded by a rim. A translucent or transparent dome shaped member is disposed above a heating chamber of the toy oven assembly and is held by the rim so that during operation of the toy oven assembly the dome shines with light giving the toy an interesting science fiction like appearance.

10 Claims, 5 Drawing Figures

FIG. 1
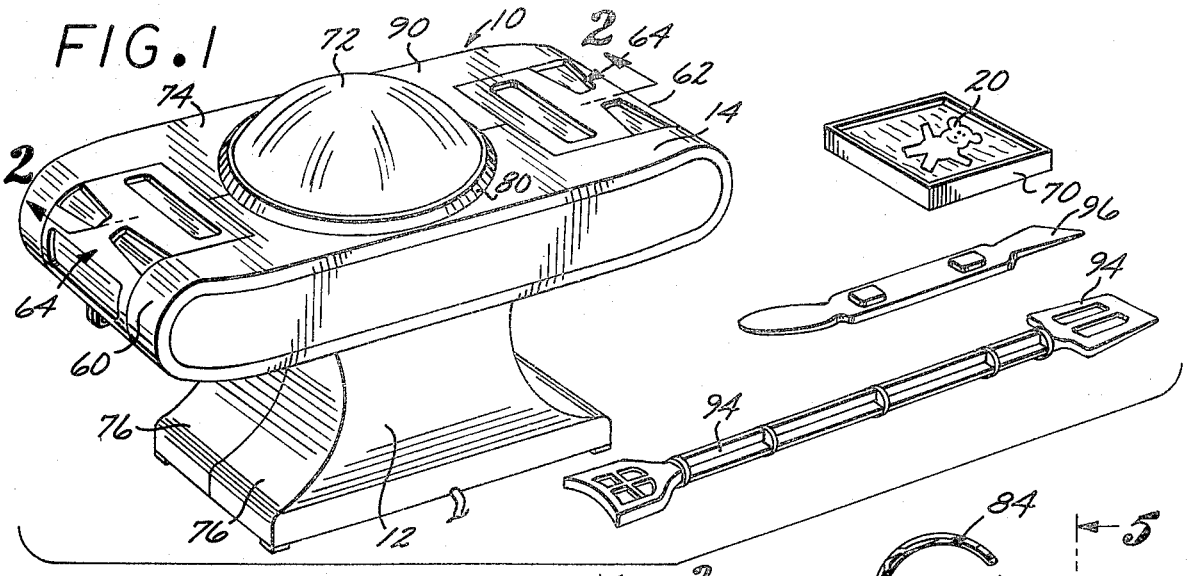
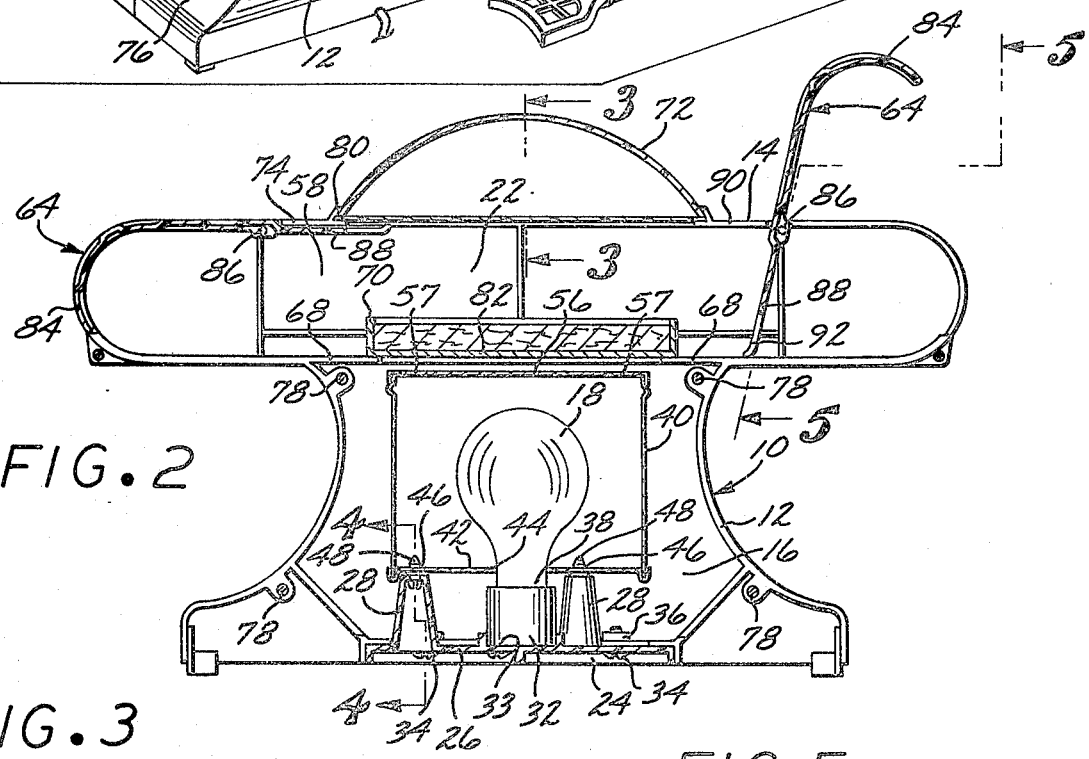
FIG. 2
FIG. 3
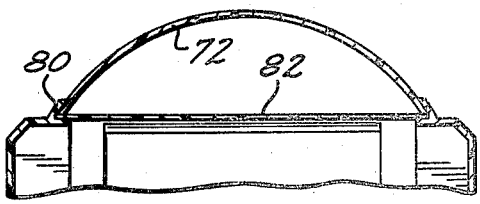
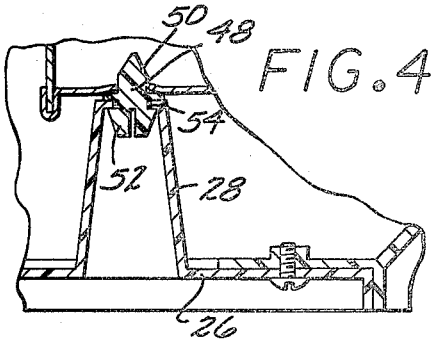
FIG. 4
FIG. 5
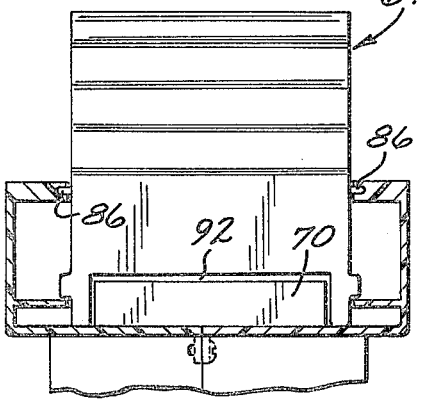

TOY OVEN ASSEMBLY

BACKGROUND OF THE INVENTION

1. Field of the Invention

The present invention is directed to a toy oven assembly. More particularly, the present invention is directed to a safe toy oven assembly having a transparent or translucent dome shaped member which shines with light when an incandescent heating element of the toy oven assembly is in operation.

2. Brief Description of the Prior Art

The prior art is well aware of toy ovens wherein real food ingredients, modeling compositions, imitation food items or the like may be cured or baked by a child. Some toy ovens of the prior art have included a light bulb which serves as a heating element for the oven. Primary concerns of the toy industry in marketing toy ovens have been, first, safety and secondly, manufacturing cost. As can be appreciated, real ovens have generally metal outer housings with insulated chambers and are not appropriate models for a safe and inexpensive toy oven design.

The toy industry, due to its inherent ever changing nature, is constantly searching for toys which provide new features and play options and thereby appeal to the creative imagination of children. A realistic duplication of the function of a real oven appeals to a child's imagination. The toy oven assembly of the present invention is such a toy.

SUMMARY OF THE INVENTION

It is an object of the present invention to provide a toy oven assembly wherein light emitted by an incandescent heating element shines through a dome shaped transparent or translucent member thereby indicating operation of the toy oven assembly and providing an interesting appealing appearance to the same.

It is another object of the present invention to provide a toy oven assembly of a unique appearance wherein a modeling composition or like item to be exposed to heat is placed into a heating chamber comprising a part of a channel provided in a substantially horizontally disposed member of the oven.

These and other objects and advantages are attained by a toy oven assembly having a base member which includes an incandescent heating element. A substantially horizontally disposed cover member is connected to the base member. The cover member incorporates a heating chamber which is disposed above the incandescent heating element. The heating chamber is configured for horizontal insertion of a tray or like object. The tray may be a heat curable modeling composition or the like. The cover member includes a dome shaped member made either of a translucent or a transparent material. The dome shaped member is disposed over the heating chamber in such a fashion that light emitted by the heating element may be observed through the dome.

The objects and features of the present invention are set forth in the appended claims. The present invention may be best understood by reference to the following description, taken in connection with the accompanying drawings in which like numerals indicate like parts.

BRIEF DESCRIPTION OF THE DRAWINGS

FIG. 1 is a perspective view of a preferred embodiment of the toy oven assembly of the present invention, the view also showing a tray adapted to be disposed in a heating chamber of the toy oven assembly and a plurality of accessories used in conjunction with the toy oven assembly;

FIG. 2 is a cross sectional view of the preferred embodiment of the toy oven assembly of the present invention, the cross section being taken on lines 2—2 of FIG. 1, the view showing one access door of the toy oven assembly in an open position;

FIG. 3 is a partial cross sectional view of the preferred embodiment of the toy oven assembly of the present invention, the view being taken on lines 3—3 of FIG. 2;

FIG. 4 is another partial cross sectional view of the preferred embodiment of the toy oven assembly of the present invention, the view being taken on lines 4—4 of FIG. 2, and FIG. 5 is still another partial cross sectional view of the preferred embodiment of the toy oven assembly of the present invention, the view being taken on lines 5—5 of FIG. 2.

DESCRIPTION OF THE PREFERRED EMBODIMENT

The following specification taken in conjunction with the drawings sets forth the preferred embodiment of the present invention. The embodiment of the invention disclosed herein is the best mode contemplated by the inventors for carring out their invention in a commercial environment, although it should be understood that various modifications can be accomplished within the parameters of the present invention.

Referring to the drawing Figures and particularly to the cross sectional view of FIG. 2, a preferred embodiment of the toy oven assembly 10 is disclosed. The toy oven assembly 10 includes a base member 12 and a substantially horizontally disposed top or cover member 14 which is connected to the base member and forms both access and exit chambers to a heating chamber.

The base member 12 includes a cavity 16 wherein an incandescent light and heat source is mounted. The incandescent light and heat source preferably comprises a light bulb 18 which is shown on FIG. 2 although alternative sources of heat could be used.

The toy oven assembly 10 of the present invention is particularly adapted for heat curing toy objects consisting of a novel modeling composition which is described in a copending application assigned to the same assignee as the present application. The toy object 20, which can be made of the novel modeling composition by a child player (not shown), is illustrated on FIG. 1. The novel modeling composition is preferably cured at approximately 350° F. Therefore, the entire toy oven assembly 10 is designed in such a manner that approximately 350° F. in temperature can be attained in its heating chamber 22. A 100 watt light bulb provides sufficient heat to bring the heating chamber 22 to this temperature in a relatively short time so that the modeling composition can be cured in the oven assembly 10 in approximately 15 to 30 minutes. It should be specifically understood, however, that the toy oven assembly 10 of the present invention may be used for curing or baking several other modeling compositions, doughs, imitation food or like items. Accordingly, the scope of the present invention is not limited by the specific materials baked or cured in the oven, and the wattage of the light bulb 18 may be specifically adjusted for that purpose.

Referring again principally to FIG. 2, mounting of the light bulb 18 into the base member 12 is disclosed. The base member 12 includes a substantially circular hole 24 in a bottom thereof. The hole 24 is adapted to receive a substantially disk shaped support member 26 which has three substantially conically shaped projections or columns 28 projecting towards the interior of the base member 12. The columns 28 are spaced evenly on the disk shaped support member 26 substantially at 120° angular distance from one another. Only two of the columns 28 are shown on FIG. 2. A conventional socket 32 holding the light bulb 18 is mounted into an offset portion 33 located substantially in the center of the disk shaped support member 26. The disk shaped support 26 is mounted to the base member 12 by a plurality of bolts 34 and nuts 36.

The light bulb 18, except for its narrow neck portion 38 which is immediately adjacent to the socket 32 is enclosed in a metal container or cage 40. In the herein described preferred embodiment, the metal container or cage 40 is a hollow cylindrically shaped body similar in construction to a paint can. The container or cage 40 includes a bottom plate 42 which has a centrally located aperture 44. The aperture 44 accommodates the neck 38 of the light bulb 18. The bottom plate 42 has three additional spaced apertures 46 each of which accommodates a plastic mounting pin 48 best shown in FIG. 4.

Each mounting pin has a cylindrical portion 50 and a split conical portion 52. The cylindrical portion 50 is fitted into the aperture 46 in the bottom plate 42 of the container 40, and the split conical portion 52 is snap fitted into an aperture 54 located in each column 28 of the disk shaped support member 26.

The metal container 40 also has a lid 56 which is disposed directly above the light bulb 18. The lid 56 has a plurality of slots 57 in order to allow heated air and light to escape from the container 40. Two of the slots 57 are shown on the cross sectional view of FIG. 2.

Still referring principally to the cross sectional view of FIG. 2, the top or cover member 14 of the preferred embodiment of the oven assembly 10 is disclosed in detail. The top or cover member 14 is a substantially rectangular hollow body which is disposed above and connected to the base member 12. The top or cover member contains a channel 58 leading from a first shorter side 60 of the rectangular body to a second shorter side 62. An access door 64 is mounted on each shorter side 60 and 62. The access doors 64 selectively block or allow access to the channel 58.

An area of the channel 58 which is disposed above the metal container 40 and therefore above the light bulb 18 comprises the heating chamber 22. The heating chamber 22 receives the convection heat flow from the light bulb 18. The top or cover member 14 includes a pair of parallel disposed guide ribs 68 which can support a tray 70 positioned in the heating chamber 22. The tray 70 is shown on FIGS. 1 and 2. It is apparent from the above description and from an inspection of FIG. 2 that heat radiation emanating from the light 18 and from the metal container 40 and hot air rising from the same directly heats the tray 70.

A substantially dome shaped member 72 made of a translucent or a transparent material is incorporated in a top side 74 of the cover member 14 directly above the metal container 40. Light rays emitted by the light bulb 18 escape from the metal container 40 through the slots 57 provided in the lid 56 and pass around the tray 70 to light up the dome shaped member 72.

All component parts of the herein described oven assembly 10 are manufactured from materials which can withstand the operating temperature of the oven assembly 10. Polypropylene is a suitable material for the manufacture of all component parts of the oven assembly 10 except for the container 40 of the light bulb 18. As was stated above, the container 40 is made of metal. In fact, the herein described preferred embodiment of the toy oven assembly 10 is conveniently manufactured by injection molding two identical ambidextrous main components 76 best shown on FIG. 1, which are attached to one another by a plurality of screws received in matching apertures 78. The dome shaped member 72 is then simply entrapped in a circular rim 80 between the two main component parts 76, as is shown on FIGS. 1 and 2.

A transparent or translucent disk 82 may be optionally disposed below the dome shaped member 72 and is held by the same circular rim 80 as the dome shaped member 72.

The tray 70 which is adapted for containing a toy object such as the one shown on FIG. 1 at 20, is placed into the heating chamber 22 through either of the access doors 64. The two access doors 64 are identical in construction and accordingly only one of them is described here in detail. Each access door 64 comprises a substantially J shaped plate which has a frontal curved portion 84 and is provided with a pivot and mounting pin 86 on each of its lateral sides. One pivot and mounting pin 86 of each access door 64 is shown by dotted lines on FIG. 2. The pivot and mounting pins 86 are received and retained by matching apertures (not shown) which are provided in the top or cover member 14. As is shown on FIG. 2, the pivot and mounting pins 86 are intermediately disposed relative to the J shaped access doors 64. Therefore, in a closed position of the access door 64, shown on the left side of FIG. 2, a portion 88 of the door 64 is disposed below a top plate 90 of the cover member 14. This portion 88 is provided with a cut-out portion or notch 92 adapted to accommodate the tray 70 which may be pushed into the heating chamber 22 through the notch 92 when the access door 64 is in an open position. The open position of the door 64 is shown on the left side of FIG. 2 and the notch 92 is best shown on FIG. 5. The notch 92 is sufficiently small that a child (not shown) cannot insert his hand or fingers into the heating chamber 22 of the oven assembly 10 regardless of the open or closed positioning of the access doors 64. Thus, the arrangement and shape of the access doors 64 provides a safety means which allows only the insertion of the tray 70 into the heating chamber and prevents injury to the child.

A stylized pusher bar 94, shown on FIG. 1, is provided with the toy assembly 10 of the present invention. The pusher bar 94 is particularly well adapted for pushing the tray 70 through the notch 88 of either access door 64. After the heating, baking or curing process is completed, the pusher bar 94 is inserted through the notch 92 of either opened access door 64 and the tray 70 is pushed out of the heating chamber 22 through the notch 94 of the other opened access door 64.

The play options provided by the toy oven assembly 10 of the present invention should be readily apparent from the above description. A child player (not shown) may readily fashion an object of any desired configuration from the above discussed heat curable modeling composition. A sculpting tool 96 with which the child may work the modeling composition is shown on FIG.

1. Alternatively, the child (not shown) may use several types of doughs, imitation food items and even certain real food items for baking in the toy oven assembly 10 of the present invention. When the oven assembly 10 is in operation the translucent dome shaped member 72 appears as a shining dome giving the oven assembly 10 an appealing science fiction like or futuristic appearance. In the event the dome shaped member 72 is made of a transparent rather than translucent material, the child player (not shown) may look through the dome to observe the actual curing or baking process.

Several modifications of the present invention may become readily apparent to those skilled in the toy manufacturing arts in light of the above disclosure. Accordingly, the scope of the present invention should be interpreted solely from the following claims.

What is claimed is:

1. A toy oven assembly comprising:

a base member incorporating a heating element;

a substantially horizontally disposed cover member connected to the base member, the cover member incorporating a channel passing from a first end of the cover member to a second end of the cover member, the channel including space located directly above the heating element and comprising a heating chamber, the channel being adapted for accommodating a tray which may be pushed through the channel and may be allowed to dwell in the heating chamber; the cover member further including on a top substantially horizontally disposed surface thereof a substantially circular aperture surrounded by a rim;

a substantially hemispherical dome comprising one of a transparent and a translucent material which is disposed directly above the heating chamber, a lower edge of the dome being held by the rim, and at least a first substantially J shaped access door mounted in the cover member, the access door selectively blocking or opening entry to the channel at the option of a player, the access door includes a front curved portion, an intermediate portion and an end portion, the access door is pivotably mounted to the cover member, the end portion of the access door including a notch adapted for allowing entry of the tray into the channel when the access door is in a position selectively allowing entry into the channel, the notch being sufficiently small so as to prevent entry of a child's hand or fingers into the channel.

2. The invention of claim 1 wherein the cover member includes a second access door mounted on a substantially horizontally disposed axis to pivot relative to the cover member, the access doors normally occupying a first position wherein access to the heating chamber is blocked, each access door being pivotable to a second position wherein the tray may be pushed in and out of the heating chamber through either of the access doors.

3. The invention of claim 2 wherein the cover member is configured substantially in the shape of an elongated rectangle having a pair of longer and a pair of shorter sides, one access door being located on each of the shorter sides.

4. The invention of claim 3 wherein the incandescent heating element is a light bulb.

5. The invention of claim 4 further comprising a metal cage substantially enclosing the light bulb, the metal cage being mounted to the base.

6. The invention of claim 5 wherein the light bulb is mounted for a substantially vertical disposition in the cage.

7. A toy oven assembly comprising:

a first and second component part, said first and second component parts being attached to one another and each being of a unitary construction and being identical with one another, the attached first and second component parts together forming a base member;

a heating element attached to the base member;

a cover member incorporating a heating chamber disposed above the heating element, the heating chamber being adapted for receipt of a tray containing an object made of a heat curable modeling composition;

an entrance channel communicating with the heating chamber, and a J shaped access door having a front curved portion, an intermediate portion and an end portion, the access door being pivotably mounted to the cover member, the end portion of the access door including a notch adapted for allowing entry of the tray into the channel when the access door is in a position permitting entry to the channel, the notch being sufficiently small so as to prevent entry of a child's hand or fingers into the channel.

8. The invention of claim 7 wherein the cover member includes substantially horiziontally disposed, spaced support members adapted for supporting the tray above the heating element.

9. The invention of claim 8 further comprising a metal cage substantially enclosing the heating element, the metal cage being attached to the base member.

10. The invention of claim 7 wherein the heating element is a light bulb.

* * * * *